US010240356B2

(12) United States Patent
Mackay Sim

(10) Patent No.: US 10,240,356 B2
(45) Date of Patent: Mar. 26, 2019

(54) NARROW EDGE LIFTING INSERT

(71) Applicant: Rodney Mackay Sim, Paddington (AU)

(72) Inventor: Rodney Mackay Sim, Paddington (AU)

(73) Assignee: Rodney Mackay Sim, Paddington (AU)

( * ) Notice: Subject to any disclaimer, the term of this patent is extended or adjusted under 35 U.S.C. 154(b) by 0 days.

(21) Appl. No.: 15/738,700

(22) PCT Filed: May 25, 2016

(86) PCT No.: PCT/AU2016/050398

§ 371 (c)(1),
(2) Date: Dec. 21, 2017

(87) PCT Pub. No.: WO2016/205873

PCT Pub. Date: Dec. 29, 2016

(65) Prior Publication Data

US 2018/0187436 A1 Jul. 5, 2018

(30) Foreign Application Priority Data

Jun. 24, 2015 (AU) ..... 2015902722

(51) Int. Cl.
*B66C 1/66* (2006.01)
*E04B 1/04* (2006.01)
(Continued)

(52) U.S. Cl.
CPC ..... *E04G 21/142* (2013.01); *B66C 1/666* (2013.01); *E04G 15/04* (2013.01); *E04B 1/04* (2013.01); *E04B 2103/02* (2013.01)

(58) Field of Classification Search
CPC ..... E04G 21/142; E04G 15/04; B66C 1/666; E04B 1/04; E04B 2103/02
See application file for complete search history.

(56) References Cited

U.S. PATENT DOCUMENTS 4,173,856 A * 11/1979 Fricker ..... E04G 21/142 248/499
8,172,289 B2 * 5/2012 MacKay Sim ..... E04G 21/142 294/82.35
(Continued)

FOREIGN PATENT DOCUMENTS

AU 639908 8/1993
AU 2008265491 A1 * 12/2008 ..... B66C 1/666
(Continued)

OTHER PUBLICATIONS

Search Report and Written Opinion for related EPO Application No. 16813381.7 (8 pages) (Year: 2018).*
(Continued)

*Primary Examiner* — Rodney Mintz
(74) *Attorney, Agent, or Firm* — Beem Patent Law Firm

(57) ABSTRACT

A lifting insert, particularly for embedment in the edges of thin concrete elements is disclosed. The insert has a head at one end which has a through aperture for the connection of a co-operating lifting link and another end for embedment within the concrete. The head of the insert has an interior region bounded on each side by an exterior region which extends to the longitudinal edges of the insert. The exterior region is thicker than the interior region and the boundary between the two regions defines an abutment surface. The thickness and width of the interior region is dimensioned to allow the lifting link to be connected to the head of the insert and the thickness of the outer region is dimensioned so as to restrict the rotation of the lifting link when a load is applied normal to the axis of the insert, and to effectively transfer the load by a couple developed across the full cross-section of the insert e.g. when tilting the concrete element from a horizontal position to a vertical position.

21 Claims, 6 Drawing Sheets

(51) Int. Cl.
*E04G 15/04* (2006.01)
*E04G 21/14* (2006.01)

(56) References Cited

U.S. PATENT DOCUMENTS

| | | | | |
|---|---|---|---|---|
| 8,764,084 | B2 * | 7/2014 | MacKay Sim | E04G 21/142 294/82.35 |
| 8,959,847 | B2 * | 2/2015 | Recker | B66C 1/666 52/125.5 |
| 2003/0208968 | A1 | 11/2003 | Lancelot, III et al. | |
| 2008/0196324 | A1 * | 8/2008 | MacKay Sim | E04G 21/142 52/125.4 |
| 2010/0176614 | A1 * | 7/2010 | MacKay Sim | B66C 1/666 294/82.35 |
| 2012/0161458 | A1 * | 6/2012 | Sim | B66C 1/666 294/82.35 |
| 2013/0340357 | A1 | 12/2013 | Recker et al. | |

FOREIGN PATENT DOCUMENTS

| | | | |
|---|---|---|---|
| EP | 1 479 641 | A2 | 11/2004 |
| WO | 2011047830 | A1 | 4/2011 |

OTHER PUBLICATIONS

Notification of Transmittal of the International Search Report dated Jul. 15, 2016, issued in International Application No. PCT/AU2016/050398 (5 pages).

* cited by examiner

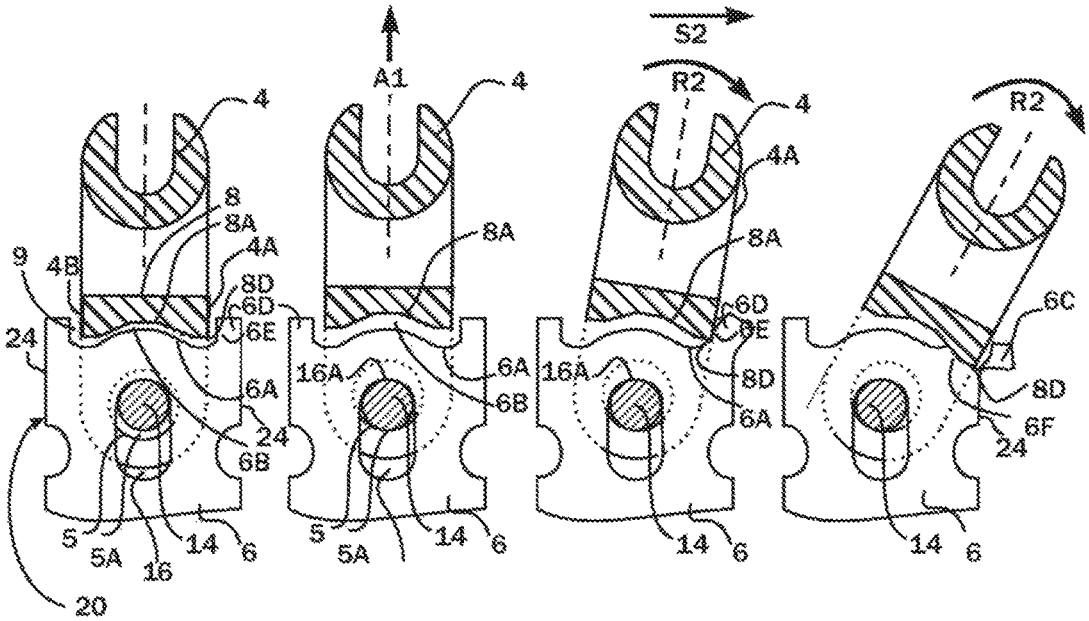
Fig. 2I Prior Art
Fig. 2J Prior Art
Fig. 2K Prior Art
Fig. 2L Prior Art
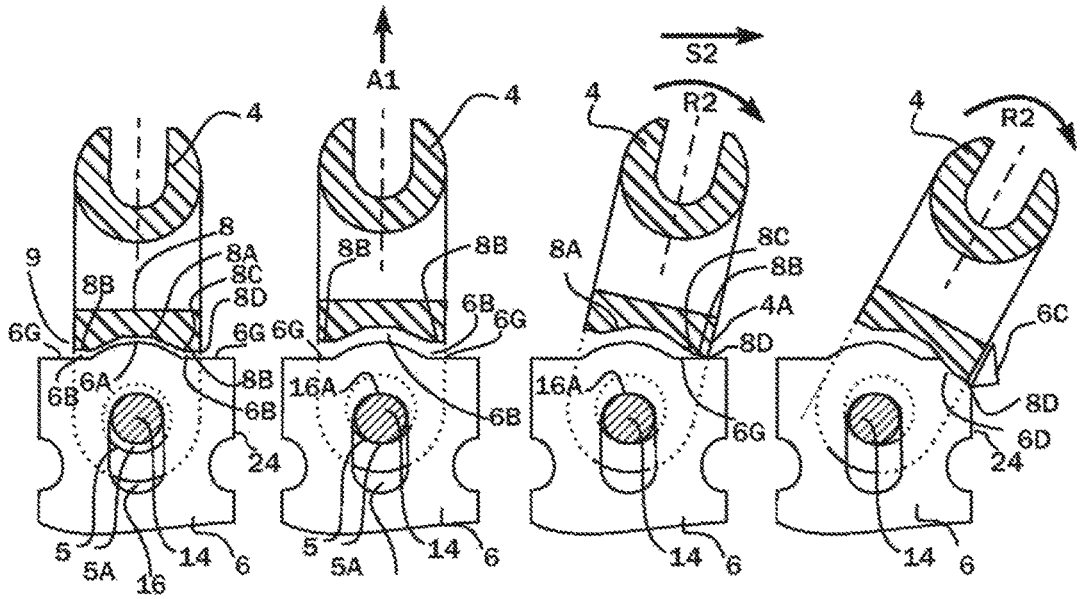
Fig. 2M Prior Art
Fig. 2N Prior Art
Fig. 2O Prior Art
Fig. 2P Prior Art

NARROW EDGE LIFTING INSERT

This application claims benefit of PCT/AU2016/050398 filed May 25, 2016, which claims benefit of Australian Patent Application No. 2015902722, filed Jun. 24, 2015, both of which are incorporated by reference in its entirety.

BACKGROUND

1. Field of the Invention

The present invention relates to a lifting insert embedded in a concrete panel element to enable it to be safely lifted during the multitude of lifting, turning and transport operations required between initial casting of the element and erection of the element into its final position.

2. Background

The construction of buildings and other structures is facilitated by using walling elements in the form of thin concrete panels. These concrete panel wall elements are most commonly cast in the horizontal position. Panels are often manufactured in factories after which the panels must be transported to the job site for erection.

The panels are often turned from the edgewise orientation convenient for transport from the factory to the job site, to an end-wise orientation for their erection as wall panels of the building.

Preferably the panels are lifted by their edges to enable them to be erected in the truly vertical position. This is particularly advantageous for panels which are to be attached to framework or other building structures or erected against other components.

Releasable lifting links for connection between embedded lifting inserts and the hoisting chains are known. One known type of link is that disclosed in Australian Patent 2008265491 and is used to connect to the head of an insert having a generally planar body which is embedded in concrete. This insert incorporates a through aperture to which a latching device incorporated within the releasable link attaches. The insert is cast within a surrounding recess such that the head of the insert lies below the surface of the concrete thereby protecting it from damage.

The lifting link has the form of a hollow ring, or a toroidal body, and a pivotable shackle element for connection to the hoisting system passing through the internal transverse hole of the toroidal body. The lower part of the toroidal body has a transverse slot which enables it to envelope the head of the insert. An arcuate latching device of a circular cross-section is fitted to rotate within the hollow arcuate cavity of the toroidal body.

The latching device has a semi-circular configuration and incorporates a radial arm which extends from one end and which facilitates the rotation of the latching device. The upper periphery of the toroidal body is removed to form a U-shaped slot through which the radial arm passes during rotation.

Connection of the lifting link to the insert is achieved by rotation of the latching device such that it lies within the hollow body in a position where it does not obstruct the transverse slot in the toroidal body. The toroidal body then partially envelopes the insert head such that the axis of the hollow chamber within the toroidal body is aligned with the axis of the aperture in the insert head. The arcuate latching ring is then rotated within the hollow chamber of the toroidal body so that it passes through the aperture in the insert head, thereby connecting the insert to the lifting link.

Most commonly, such thin concrete panels are cast on flat casting moulds rather than on their edges. Problems arise when these panels are to be tilted from their horizontal cast position into the vertical position for erection into the building using lifting inserts located in the edges of the panels.

The shear forces between the lifting link and the insert which arise during the tilting up process causes the link to rotate about the insert head at the point of attachment and causes the underside of the transverse aperture of the toroidal body to bear against the top edge of the insert. Elastic and plastic deformation of the top edge of the insert as a result of the compressive bearing force may be sufficient to cause the toroidal body of the link to rotate to such an extent that it bears against the concrete.

In thin panels this bearing force may result in failure of the concrete edge. Depending on the manner in which the insert is located in the panel, edge failure may result in either cosmetic damage and/or complete pullout of the insert from the panel. The latter has severe consequences for safety and property damage.

One attempt to overcome these problems is disclosed in U.S. Pat. No. 4,173,856 (Fricker) in which an insert was provided with axially aligned abutment surfaces extending from the top edge of the insert and which trap the rotation of the toroidal link. A further attempt is disclosed in AU 639908 (Ramset) in which the insert and toroidal body were provided with upwardly facing, lateral abutment surfaces which limited the rotation of the link body about the insert head. Inserts relying on either or both of these disclosed methods have been used with limited success for many years. A disadvantage of arrangements relying on either of these two disclosures is that in practice, successful designs have required the use of relatively wide inserts. This is because the width of the insert beyond the abutting side of the toroidal link which bears upon the edge of the insert must be sufficiently wide so as to withstand the shear forces generated in the edge of the insert in the lifting direction. Consequently this limits the use of these inserts to relatively thick panels.

SUMMARY

An object of the invention is a desire to provide an insert able to be used in thin panels without breaking the panel edges.

In accordance with a first aspect of the present invention there is disclosed a lifting insert for embedment in a concrete element to facilitate lifting of the element by a lifting link, said lifting link having a hollow toroidal body with two exterior cheeks and a substantially semi-circular latch which extends across a slot in said toroidal body, said insert having a head at one end for releasable engagement with said lifting link and another end for embedment within the concrete element, said head having an aperture for receiving said lifting link latch, said aperture having an axis, and said head being dimensioned so that it is receivable within said slot; wherein said head is of non-uniform thickness, such that in at least one region of said head the width of the head, in a direction parallel to the axis of said aperture, exceeds the distance between the cheeks, thereby forming at least one abutment surface against which a cheek of said toroidal body bears during lifting.

In accordance with another aspect of the present invention there is disclosed a method of raising a substantially planar concrete element having a substantially vertical side edge into which is cast an elongate lifting insert having a head of non-uniform thickness which is accessible from said side edge, and which includes an accessible aperture therethrough, said aperture having an axis said method comprising the steps of:

(a) engaging said head with a generally toroidal lifting link body having a slot dimensioned to receive said head, said slot being located between a pair of cheeks;

(b) engaging a latch of said body with said aperture; and (c) raising said body whilst engaging one of said cheeks with at least one region of said head which, in a direction parallel to said aperture axis, exceeds the distance between said cheeks, said region forming an abutment surface for said one cheek, which abutment surface extends longitudinally along said head.

BRIEF DESCRIPTION OF THE DRAWINGS

Preferred embodiments of the present invention will now be described with reference to the drawings in which:

FIG. 2I is a vertical cross-section through the body of the lifting link aligned with the transverse slot of the body of the prior art lifting link, and with no load applied, the prior art insert having nibs, FIG. 2J is the same view as FIG. 2I but with load applied axially between the link and insert, FIG. 2K is the same view as FIG. 2J but after rotation of the prior art body until it comes to rest against the upper face of the insert, FIG. 2L is the same view as FIG. 2K but after further rotation of the prior art lifting link body causing a portion of the insert to be sheared off, FIG. 2M is a vertical section of the prior art lifting link body aligned with its transverse slot with the prior art lifting link connected to a co-operating insert of a form which provides an abutment shoulder projecting substantially normal to the insert axis, FIG. 2N is the same as FIG. 2M with load applied axially between the link and insert, FIG. 2O is the same view as FIG. 2N but after rotation of the body until it comes to rest against the abutment shoulder of the insert, FIG. 2P is the same view as FIG. 2O but after further rotation of the prior art body causing a portion of the insert to be sheared off in a similar manner to that illustrated in FIG. 2L.

DETAILED DESCRIPTION OF THE PREFERRED EMBODIMENTS

Figure 1:
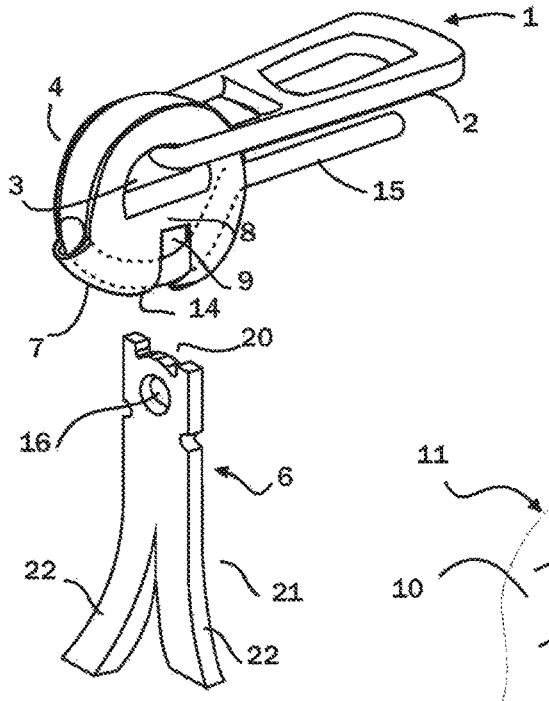
Fig. 1 Prior Art
FIG. 1 is a perspective view of a prior art lifting link and co-operating insert.
Figure 2A:
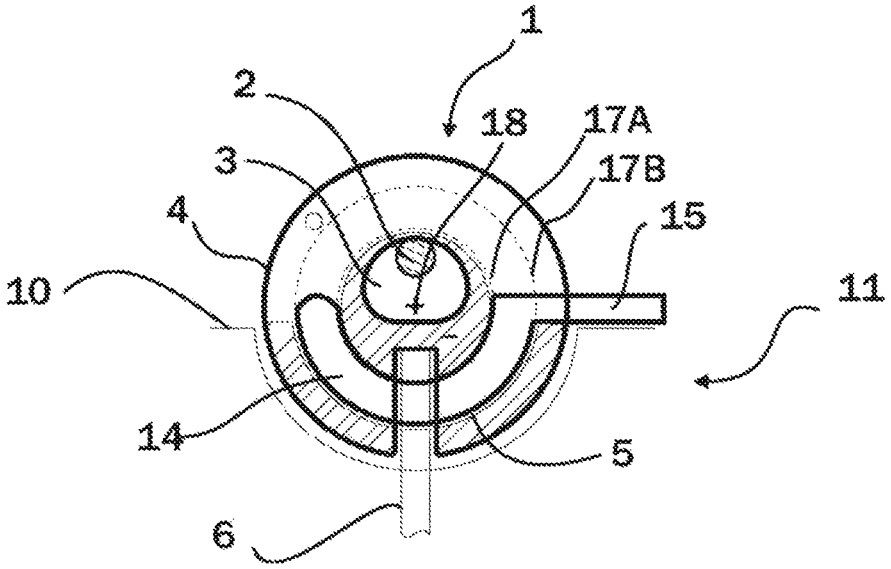
Fig. 2A Prior Art
FIG. 2A is a vertical section through the prior art lifting link of FIG. 1.
Figure 2B:
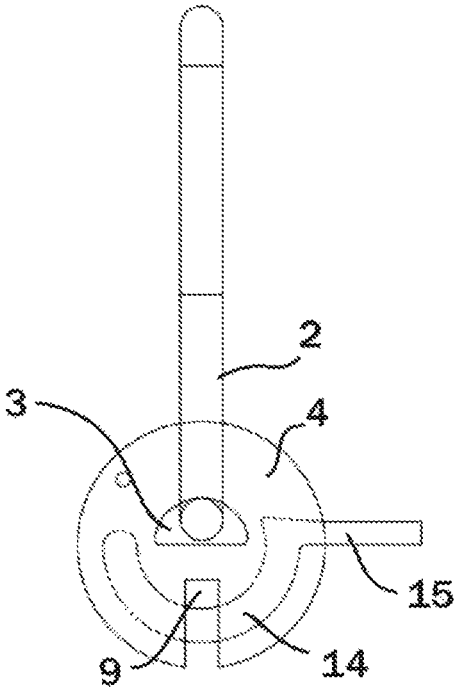
Fig. 2B Prior Art
FIG. 2B is a side elevation of the prior art lifting link and shackle.
Figure 2C:
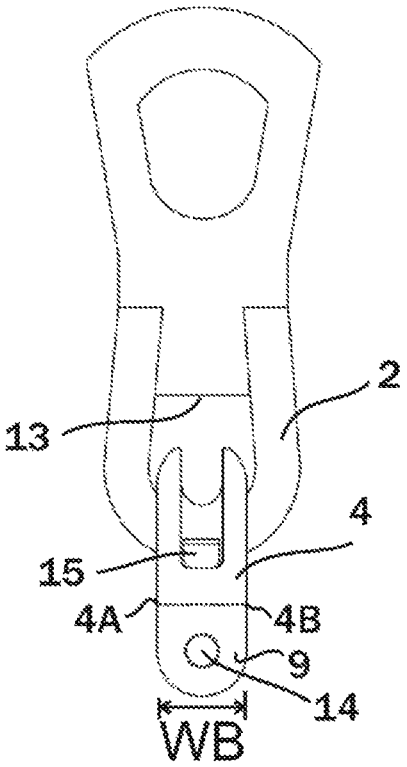
Fig. 2C Prior Art
FIG. 2C is a rear elevation the prior art lifting link and shackle.
Figure 2D:
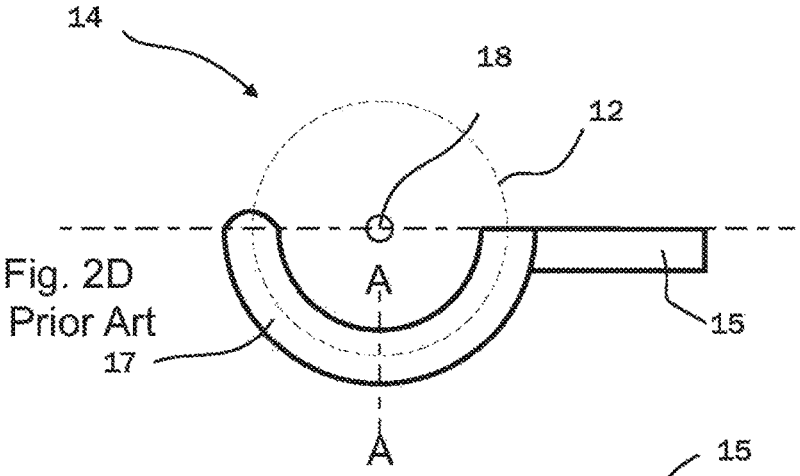
Fig. 2D Prior Art
FIG. 2D is a side elevation of the prior art latch.
Figure 2E:
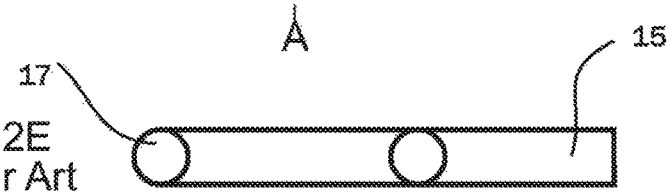
Fig. 2E Prior Art
FIG. 2E is plan view of the prior art latch.
Figure 2F:
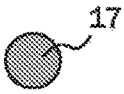
Fig. 2F Prior Art
FIG. 2F is a vertical section A-A through the prior art latch of FIG. 2D.
Figure 2G:
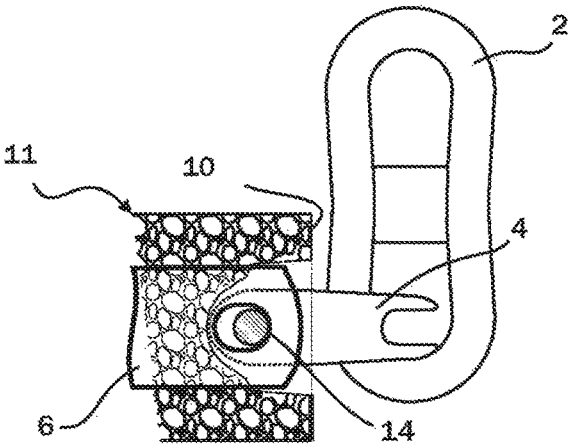
Fig. 2G Prior Art
FIG. 2G is a vertical section through a prior art insert embedded in the edge of a horizontal concrete panel to which is connected a prior art link for lifting in the vertical direction, thereby applying a shear force between the link and the insert.
Figure 2H:
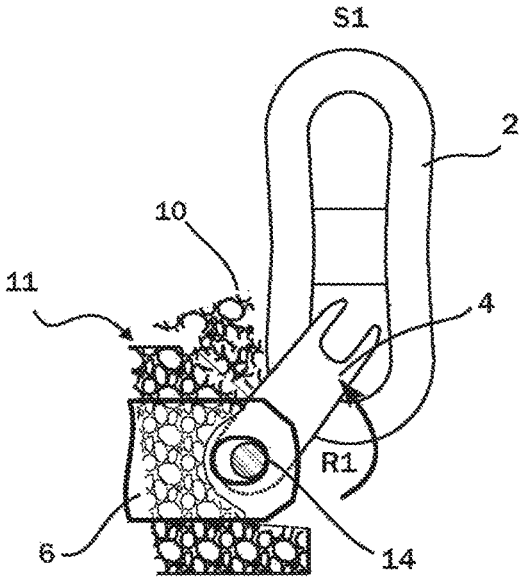
Fig. 2H Prior Art
FIG. 2H is the same view as FIG. 2G but after the load has been applied to the lifting link in the vertical direction, thereby causing rotation of the link about the insert head and breakage of the edge of the concrete panel in the direction of lift.

As seen in FIGS. 1-2H the prior art lifting link 1 is attached to hoisting chains (not illustrated) with a shackle 2 or similar element which passes through a central hole 3 in the toroidal body 4 of the link 1. When the known lifting link 1 is closed over the embedded insert 6, a segment 7 of the toroidal body 4 lies below the surface of the concrete. The body of the torus is strengthened by a transverse bridge 8 which lies above a transverse slot 9 of width WB (FIG. 2C) which intersects the side faces 4A and 4B of toroidal body 4, into which the insert 6 is mated. The effect of this bridge 8 is to partially close the central aperture 3 which results in the central aperture 3 having a rounded generally semicircular profile with its diameter generally flush with the concrete surface.

Within the hollow toroidal body 4 of the lifting link 1 is an arcuate latch 14 (as seen in FIG. 2A) which has an arcuate latching part 17 of substantially circular cross section as shown in FIG. 2D with an arcuate central axis 12 and a radial arm 15. The latch 14 passes through a transverse aperture 16 in the head 20 of the insert 6 of FIG. 1. The latch 14 is rotatable within the interior cavity 5 shown in FIG. 2A of the toroidal body 4. The latch 4 rotates within the arcuate cavity 5 along a path of rotation described by broken lines 17A and 17B. The arcuate length of the latching part 17 is substantially one-half of the length of the path of rotation defined by broken lines 17A and 17B. The radii of curvature of the latch 14 and the interior cavity 5 of body 4 are the same and have co-incident centres 18 (FIGS. 2A and 2D).

As seen in FIGS. 2A-2C, the shackle 2 passes through the central aperture 3 in the toroidal body 4 and is free to rotate in all directions above the plane of the concrete to facilitate a lifting operation originating from any direction above the concrete plane.

Figure 1A:
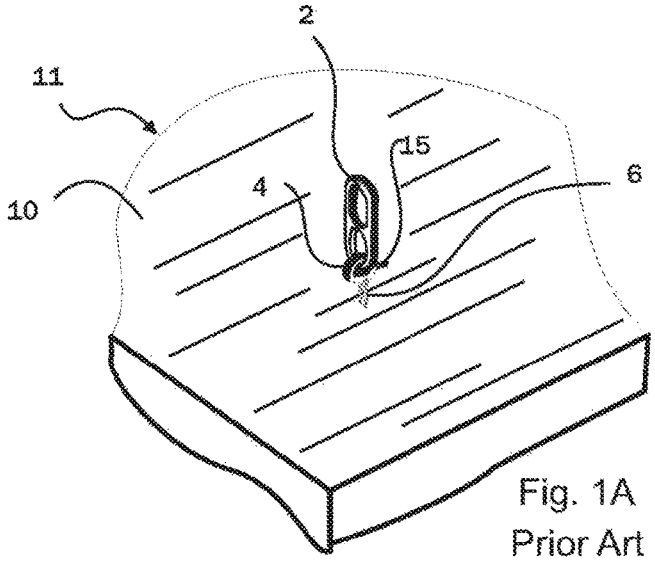
Fig. 1A Prior Art
FIG. 1A is a perspective view of a prior art lifting link and co-operating insert embedded in the face of a concrete panel.
Figure 1C:
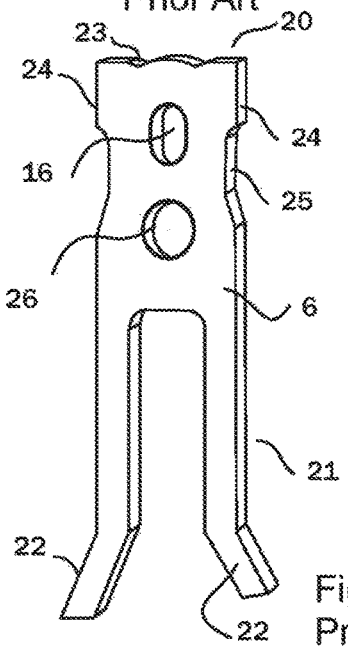
Fig. 1C Prior Art
FIG. 1C is a perspective view of a prior art insert of a commonly used form.

As seen in FIG. 1C, a prior art lifting insert 6 incorporates a head 20 adjacent to the aperture 16 for connection to the lifting link and an end 21 for embedment within the concrete element. The embedded end 21 incorporate a means for generating an interlock with the concrete 10 which could be either a shaped key element or elements 22 or one or more apertures 26 into which reinforcement elements (not shown) may be fitted to provide interlock between the insert 6 and the concrete 10. The end edge 23 of the head of the the insert 6 is shaped to co-operate with the underside of the bridge 8 of the body 4 of the lifting link 1. The longitudinal edges 24 can be waisted at one or more locations 25 between the head 20 of the insert 6 and the distal region 21 of the insert 6 to receive additional reinforcement means (not shown) for the concrete of the panel.

Figure 1B:
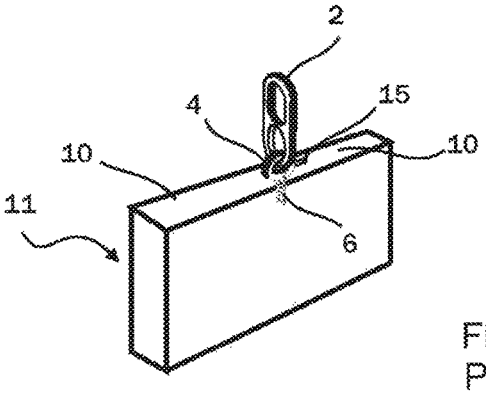
Fig. 1B Prior Art
FIG. 1B is a perspective view of a prior art lifting link and co-operating insert embedded in the edge of a concrete panel.

The original purpose for these prior art lifting links 1 and inserts 6 was for lifting concrete elements 11 with inserts 6 placed in the horizontal top faces of concrete panels as shown in FIG. 1A and element horizontal edges 10 shown in FIG. 1B.

However, when lifting inserts 6 are located in the vertical edge of a concrete element 11, as shown in FIG. 2G, and are used for tilting the element 11 from the horizontal to a vertical or near vertical position, the direction of load applied between the body 4 and the insert 6 changes from a substantially axial load to a shear load for which the system was not originally intended. This change is load is with respect to the insert 6, the torus 4 and the latch 14. The body 4 and latch 14 are free to rotate about the insert because the prior art latch 14 has a generally uniform circular cross section. Rotation of the link causes the body 4 to bear against the thin edge 10 of the concrete panel which, if it is unable to withstand the load, breaks away as shown in FIG. 2H, resulting in damage to the edge 10 of the panel 11. In certain cases the insert 6 can break free of the panel 11. Prior art inserts 6 are known to have abutment surfaces on the end edge 23 (FIG. 1C) which provide resistance to rotation between the body 4 and insert 6.

FIGS. 2I-2L show the effect of rotation of a prior art link 4 about an insert as taught by U.S. Pat. No. 4,173,856 (Fricker). As seen in FIG. 2I the bridge 8 of the prior art body 4 has an interior surface 8A which extends from the side surfaces 4A and 4B of the body 4 for the width of the transverse slot 9. The intersection of this surface 8A with sides 4A and 4B defines a line of point contact 8D. The insert 6 has longitudinally projecting nibs 6D disposed on each side of the insert about the aperture 16 and these nibs define inwardly facing abutment surfaces 6E intended to provide resistance to rotation of the body 4 about the insert 6.

FIG. 2I shows the situation when the body 4 is connected to an insert 6 by the locking ring 14 through the aperture 16 of the insert 6, prior to load being applied between the body 4 and the insert 6. A clearance space 5A between the inner toroidal cavity surface 5 and the locking ring 14 and a clearance space 6B between the surface 8A of the body 4 and surface 6A of the upwardly facing surface of the insert 6, are required to permit the unimpeded connection between the body 4 and the insert 6. This permits the free rotation of the locking ring 14 within the toroidal cavity 5 so as to pass through the aperture 16 of the insert 6 and fully across the transverse slot 9.

FIG. 2J shows the connected body 4 and insert 6 of FIG. 2I after a load has been applied in an axial direction (relative to the insert 6) shown by the arrow A1. It can be seen that the clearance space 5A between the inner toroidal cavity 5 of the body 4 and the locking ring 14 has been closed. This has the effect of increasing the distance between the downwardly facing surface 8A of the body 4 and the upwardly facing surface 6A of the insert 6.

FIG. 2K shows the connected body 4 and insert 6 of FIG. 2J after application of a small shear load in the direction shown by arrow S2 toward the side edge 24 (FIG. 1C) of the insert 6. This results in a rotation shown by arrow R2 of the body 4 with respect to the insert 6 about the locking ring 14 and surface 16A of aperture 16 of the insert 6. Whereupon the side surface 4A of the body 4 bears against the abutment surface 6E of the nib 6D of the insert 6.

Under light loads, the nib 6D is capable of resisting the load elastically but the application of further loading causes the nib 6D to bend, offering no further resistance to the load until the line of point contact 8D of the body 4 abuts the upwardly facing surface 6A of the insert 6. It can be readily seen that the intersection of the line of point contact 8D of the surfaces 8A and 4A of the body 4 defines a sharp corner which acts as a cutting blade in line contact with the surface 6A of the insert 6. The remainder of the downwardly facing surface 8A of the body 4 makes no contact with the upwardly facing surface 6A of the end edge 23 of the insert 6.

FIG. 2L shows the connected body 4 and insert 6 of FIG. 2K after the shear load S2 has been increased to a critical intensity such that the rotational force R2 exceeds the shearing resistance of the material of the insert 6 because of the concentrated load at the sharp corner 8D. The corner 8D acts as a knife edge which cleaves a portion 6C from the insert 6 along a surface 6F to the edge 24 of the insert 6, at a low load. After removal of portion 8C, the insert 6 offers no further resistance to the rotational load. Consequently, the situation is the same as shown in FIG. 2H where the body 4 is free to rotate about the insert 6 unimpeded, causing fracture and spalling away of the concrete surrounding the insert 6 of the of the concrete panel 11.

FIGS. 2M-2P show the effect of rotation of a prior art link 4 about an insert as taught by AU639908 (Ramset) whereby the insert 6 has an upwardly facing abutment surface 6A disposed so as to make two substantially horizontal shoulders 6G, lying one to each side of the axis of the connection hole 16 of the insert 6 and extending outwardly to the edges 24 of the insert 6. The slot 9 in the body 4 has a bridge 8 which has a downwardly facing surface 8A shaped so as to define substantially horizontal abutment surfaces 8B on each side of the body 4 which extend inwardly from the body surface 4A from point 8D to 8C. These abutment surfaces 8B are substantially normal to the surface 4A and the vertically opposing abutment surfaces 6G of the insert 6.

FIG. 2M shows the connected body 4 and the insert 6 prior to the application of an axial load A1 between the body 4 and the insert 6. There is only a small clearance 6B between the upwardly facing abutment surface 6G of the insert 6 and the downwardly facing abutment surface 8B of the body 4 as taught and illustrated in FIG. 5 of AU639908 (Ramset). FIG. 2N is as described above for FIG. 2J after a load has been applied between the body 4 and the insert 6. It can be seen that the clearance 6B between the abutment surfaces 8B and 6G has substantially increased.

FIG. 2O is similar to FIG. 2K and demonstrates the effect of rotation of the body 4 in a direction A2 under a light shear load S2 so as to cause the body 4 to rotate in the direction indicated by arrow R2 and to come in contact with the abutment surface 6G of the insert 6. As described for FIG. 2K above it can be seen that the abutment surface 8B of the body 4 does not actually make contact with the opposing abutment surface 6G of the insert except for a line of intersection at corner 8D. AU639908 (Ramset) alleges that the surface 6G provides resistance due to bearing on the surface 8B. However, this can be seen not to be the case. The effect is no different to that of the line contact which is described above for FIG. 2L. The resistance to rotation is therefore not the high resistance which would be expected of two surfaces bearing against each other and implied by AU639908 (Ramset) but is instead a much lower resistance due to the shearing of the material of the insert 6 along the shear line 6D by the corner defined by the line of intersection 8D of the body 4 of the link 1 which forms an effective shear blade which cleaves through the insert material.

The resistance to rotation between the body 4 and insert 6 of these prior art inserts and links can only be increased by increasing the width of the insert 6 (i.e. in the direction 4A-4B of FIG. 2I) and nibs 6D (depending on the insert design) and the thickness of the insert 6 so as to increase the resistance of the insert 6 to failure by cleaving. The consequences are that material is wasted and the increased insert width limits the application of the insert 6 to thicker concrete panels.

What is required is a system which fully transfers the rotational loads from the body 4 into the insert 6 by so as to limit the rotation between the body 4 and the insert 6. This would substantially eliminate the risk of material cleavage toward the edge 24 of the insert 6 by the body 4 and would also substantially maximise the lifting load capacity for the narrowest possible insert 6 without failure of the insert material or the surrounding concrete 10 (FIGS. 2G and 2H) in which the insert 6 is embedded.

Figure 3:
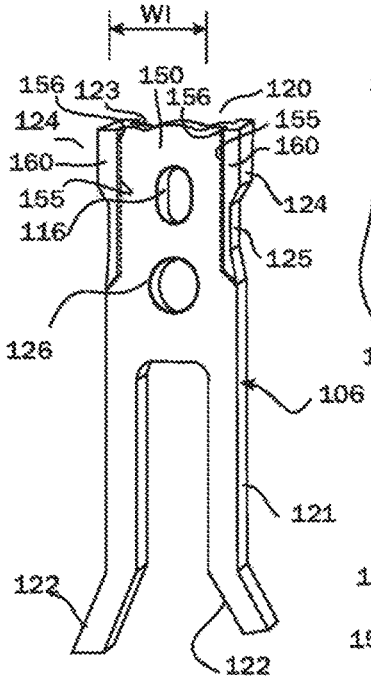
FIG. 3 is a perspective view of a first embodiment of an insert of the present invention.

FIG. 3 discloses an insert 106 of the first embodiment of the present invention which has a head 120 in which there is an aperture 116 shaped to receive the locking ring 4 of a co-operating lifting link 1 and a distal end 121 incorporating a key means 122 for interlock with the concrete 10.

Within the head 120 there is an interior region 150 and two outer regions 160. The interior region 150 extends axially to some distance below the aperture 116 from a position adjacent to the end edge 123 of the head 120 of the insert 106. In addition, the interior region 150 extends laterally to the boundaries 155 (indicated by broken lines in FIG. 3) of the exterior regions 160. Each exterior region 160 extends inwardly from the longitudinal edge 124 of the head 120 of the insert 106 to the boundary 155 of the interior region 150 and extends axially for some distance below the aperture 116 from a position adjacent to the end edge 123 of the head 120 of the insert 106.

Figure 4A:
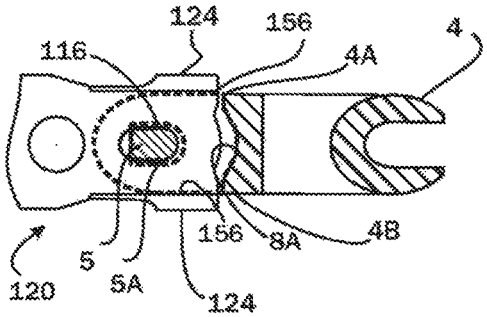
FIG. 4A is a side elevation of corresponding to FIGS. 2I and 2M but of the insert head of FIG. 3A.

The width WI of the interior region 150 is dimensioned to just exceed the width of the body 4 of the co-operating link 1, defined by the surface 8A of the transverse slot 9 of the body 4 of the link 1, which is shown as a broken line in FIG. 4A.

Figure 3A:
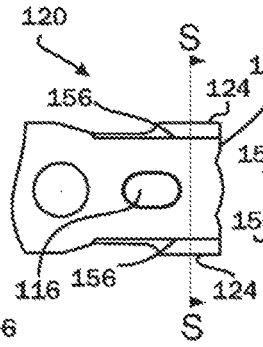
FIG. 3A is a front elevation of the head end of the insert of FIG. 3.
Figure 3B:
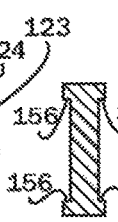
FIG. 3B is a cross section of the insert head shown in FIG. 3A at a section marked as S-S.
Figure 3C:
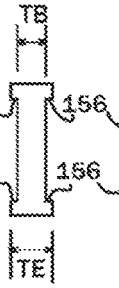
FIG. 3C is an end elevation of the head end of the insert of FIG. 3A.

FIGS. 3A, 3B and 3C show the head 120 of the insert 106. The head 120 has a uniform thickness in the inner region 150 and a different but uniform thickness in the outer regions 160. The thickness of the interior region is shown as TB and the thickness of the outer region is shown as TE in FIG. 3C. The change in thickness between the interior and outer regions forms an abutment surface 156 along the boundary 155 indicated in FIGS. 3A, 3B and 3C. The change in thickness defines a groove which extends axially between the abutment surfaces 156. Thus, the cross-section of the head of the first embodiment has the appearance of an I-beam.

Figure 3D:
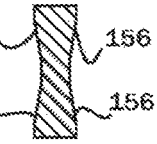
FIG. 3D is a cross section similar to that of FIG. 3B but of a second embodiment of an insert of the present invention.

FIG. 3D shows the head 120 of an insert of a second embodiment with a non-uniform thickness between region 150 and 160 wherein the thickness of the insert, and hence the depth of its groove, changes by a tapered shape. Thus, in cross-section the head of the second embodiment has the appearance of a bow tie.

Figure 3E:
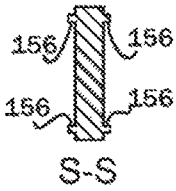
FIG. 3E is a cross section similar to that of FIG. 3B but of a third embodiment of an insert of the present invention.

FIG. 3E shows the head 120 of an insert of a third embodiment with a non-uniform thickness between region 150 and 160 with a longitudinal ridge 156 formed along both faces of the insert.

Figure 3F:
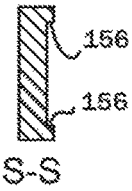
FIG. 3F is a cross section similar to that of FIG. 3B but of a fourth embodiment of an insert of the present invention.

FIG. 3F is similar to FIG. 3E however the head 120 of the insert has the ridges 156 on only one side and thus is formed in the shape of a channel.

Figure 3G:
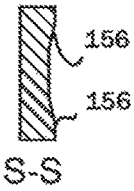
FIG. 3G is a cross section similar to that of FIG. 3B but of a fifth embodiment of an insert of the present invention.

FIG. 3G is similar to FIG. 3D however the head 120 of the insert has one flat side and thus is formed in the shape of a tapered channel.

Figure 3H:
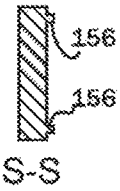
FIG. 3H is a cross section similar to that of FIG. 3B but of a sixth embodiment of an insert of the present invention.

FIG. 3H is the same as FIG. 3E except the head 120 of the insert is formed in the shape of a channel with projecting ribs 156.

Figure 3I:
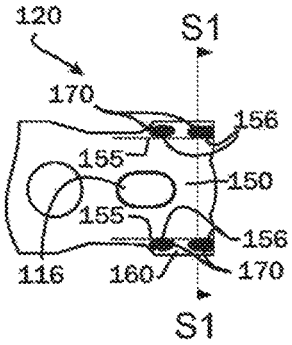
FIG. 3I is a side elevation similar to that of FIG. 3A but of a seventh embodiment of an insert of the present invention.
Figure 3J:
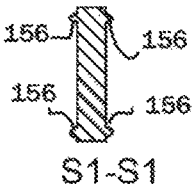
FIG. 3J is a cross section of the insert head shown in FIG. 3I at a section marked as S1-S1.
Figure 3K:
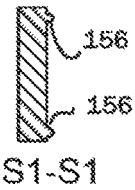
FIG. 3K is a cross section similar to that of FIG. 3I but of an eighth embodiment of an insert of the present invention.

FIGS. 3I, 3J and 3K show the head 120 of seventh and eighth embodiments of the insert 106. The head 120 has a uniform thickness in the inner region 150 and rather than a continuous rib or change of thickness, the buttressing surfaces 156 are provided by one or more raised projections 170 of thickness greater than the inner region 150. In the seventh embodiment of FIGS. 3I and 3J the raised projections are on both sides of the insert, however, in the eighth embodiment of FIG. 3K the raised projections are on only one side.

Figure 3P:
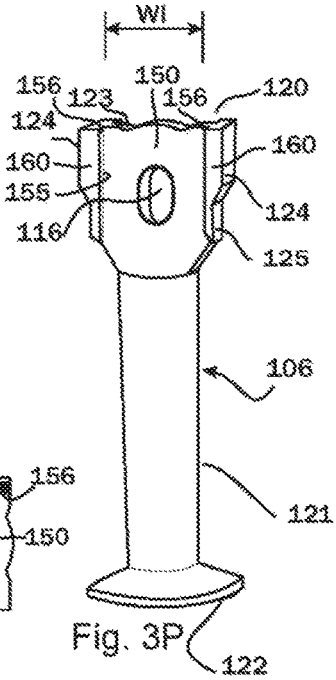
FIG. 3P is a perspective view of a thirteenth embodiment of an insert of the present invention.
Figure 3L:
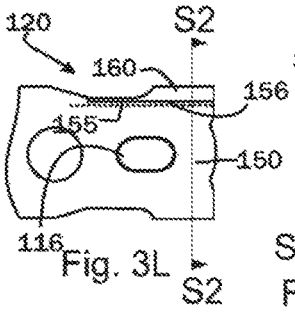
FIG. 3L is a side elevation of an insert head similar to FIG. 3A but illustrating the head of an insert of a ninth embodiment.
Figure 3M:
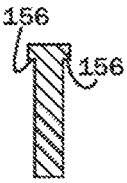
FIG. 3M is a cross section of the insert head shown in FIG. 3L at a section marked as S2-S2.
Figure 3N:
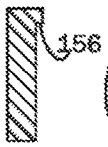
FIG. 3N is a cross-section similar to FIG. 3M but illustrating the head of an insert of a tenth embodiment.

FIGS. 3L, 3M and 3N show the head 120 of ninth and tenth embodiments of the insert 106. The head 120 of FIGS. 3L and 3M has a uniform thickness in the inner region 150 and rather than a pair of ribs or thickness changes, the buttressing surfaces 156 are provided only on one edge of the head 120. FIG. 3M shows a cross-section of head 120 of FIG. 3L with the buttressing surfaces 156 provided on one side of the aperture 116 of the head 120. FIG. 3N shows a cross section of an embodiment with a buttressing surface 156 on only one side of the head 120 and only one edge of the head 120.

Figure 3O:
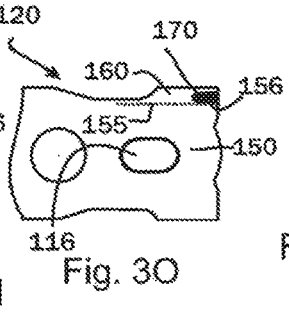
FIG. 3O is a side elevation of an insert head similar to FIG. 3A but illustrating the head of an insert of an eleventh and twelfth embodiment.

Similarly, the head 120 of FIG. 3O shows an eleventh embodiment with one or more raised projections 170 displaced on only one side of the aperture 116 of the head 120. This embodiment has a cross-section similar to that of FIG. 3M since the projections are on both sides of the insert. However, a twelfth embodiment has projections on only one side of the insert and thus has a cross-section similar to FIG. 3N.

FIG. 3P shows a thirteenth embodiment of the insert 106 with a substantially cylindrical distal end 121 and a conical shaped interlock key 122, the head 120 being substantially the same as that of FIG. 3.

Figure 3Q:
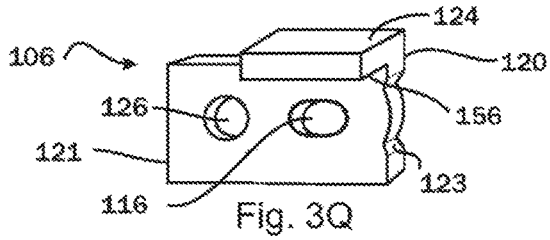
FIG. 3Q is a perspective view of a fourteenth embodiment of an insert of the present invention

FIG. 3Q shows a fourteenth embodiment of the insert 106 whereby the buttressing surface 156 of the head 120 is formed by bending or forging the head 120 into an L shape 124 as illustrated. The distal end 121 of the insert 106 of FIG. 3Q can be elongated and have the key 122 shown in FIG. 3. Alternatively, the insert 106 of FIG. 3Q can be truncated relative to the previous embodiments, as shown in FIG. 3Q. At least one aperture 126 is provided for the insertion of a co-operating reinforcement means (not shown) to interlock with the concrete 10.

Other embodiments with a non-uniform thickness in either region 150 or 160 or with different shapes for the distal end 121 or interlock key 122 can be used according to the load bearing requirements of the application in which the insert is to be used.

Figure 4B:
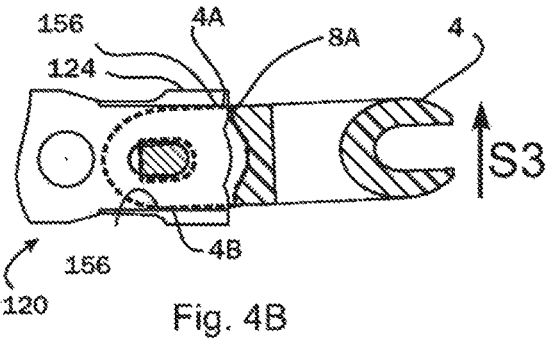
FIG. 4B is a the same view as FIG. 4A but with a load applied normal to the axis of the insert so as to cause rotation of the lifting link about the insert.
Figure 4C:
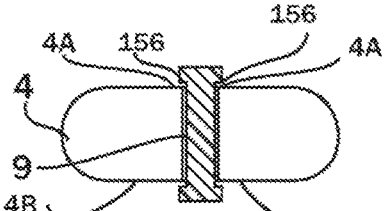
FIG. 4C is a cross section of the insert head and an end elevation of the lifting link connected to the insert shown in FIG. 4A before load is applied.

FIGS. 4A and 4C show the toroidal body 4 connected to the head 120 of the insert embodiment 106 of FIG. 3 prior to the application of a load. It can be seen that the sides 4A and 4B of the body 4 lie just within the boundaries 155 of the regions 150 and 160.

Figure 4D:
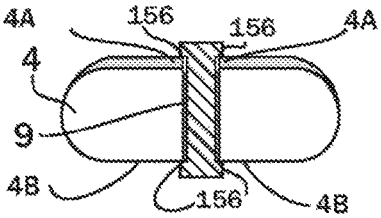
FIG. 4D is same view as FIG. 4C but with the load applied in accordance with FIG. 4B.

FIGS. 4B and 4D shows the situation after a load has been applied to the body 4 in a direction indicated by arrow S3 in a direction normal to the longitudinal axis of the insert 106. This load S3 causes the body 4 to rotate until the cheeks or sides 4A and 4B of the body 4 come into contact with the abutment surfaces 156 of the insert 106 and further rotation is prevented. The sides 4A and 4B of the body 4 bear against the abutment surfaces 156 not only adjacent to the end 123 of the head 120 but also below the axis of rotation of the head 120 about the aperture 116. This results in the development of a couple of resistance across the full width of the insert head 120. This couple effectively transfers the load S3 to the full cross section of the head 120 of the insert 106 and increases both the load carrying capacity of the head 120 of the insert 106 relative to its deflection and also minimises the rotation and deflection of the body 4 about the anchor head 120.

Unlike prior art insert 6, the load carrying capacity and deflection characteristics of the insert 106 and the attached body 4 are not limited by plastic deformation, cleaving and/or failure at the head end 123.

The load transfer mechanism of the insert 106 is superior to prior art inserts 6 where their load resistance is dependent only on the shear strength of the material between the top edge 23 and the side edge 24 of the head 20 of the insert 6.

Figure 5A:
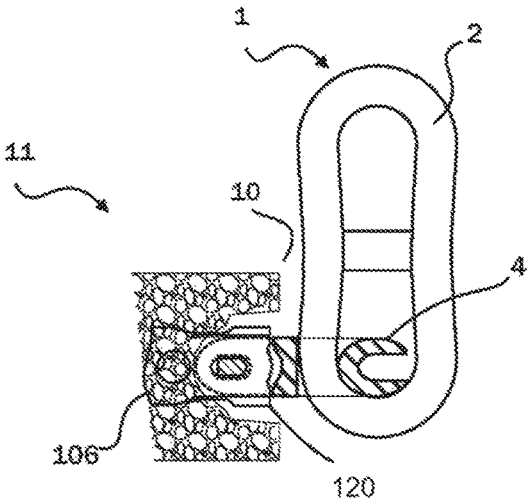
FIG. 5A shows the insert of FIG. 3 embedded in the edge of a concrete element to which is attached a co-operating lifting link and corresponds to FIG. 2G of the prior art.
Figure 5B:
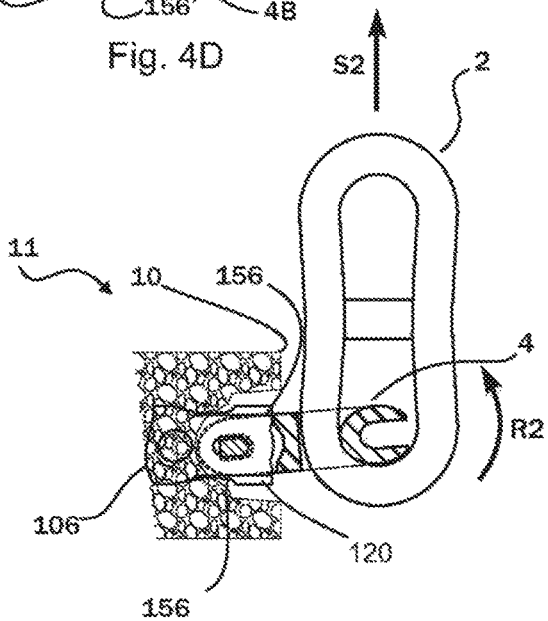
FIG. 5B is the same view as FIG. 5A but with a load applied normal to the axis of the insert and corresponds to FIG. 2H of the prior art.

FIGS. 5A and 5B are analogous to FIGS. 4A and 4B and show the head 120 of an insert 106 embedded in the thin edge 10 of a concrete element 11. The rotational lock achieved by the interaction of the sides 4A and 4B of the body 4 with the abutment surfaces 156 of the insert 106 ensures that a clear distance is maintained between the edge 10 of the concrete element 11 and the lifting link 1 during lifting operations. This prevents edge failure of the valuable concrete element 11 which can therefore be lifted without damage and without danger to personnel.

The foregoing describes only some embodiments of the present invention and modifications, obvious to those skilled in the concrete panel lifting art, can be made thereto without departing from the scope of the present invention.

It will be seen that the precise configuration of the head 120 of FIGS. 3B and 3C resembles an I-beam. This shape has two effects. Firstly the "flanges" of the I-beam create two grooves which form the abutment surfaces 156. Secondly the configuration of the I-beam has a higher second moment of inertia than a conventional flat section and therefore has an increased resistance to bending under the applied shear load during lifting. This improved bending resistance reduces the deflection of the insert 106 and the attached body 4. This in turn reduces the risk of either the insert 106 or the body 4 bearing against the concrete 10 and resulting in cracking or spalling. Instead, the cheek of the body 4 bears against the insert 106. Other configurations of the head 120 which achieve these two effects are within the scope of the present invention as defined by the following claims.

The term "comprising" (and its grammatical variations) as used herein is used in the inclusive sense of "including" or "having" and not in the exclusive sense of "consisting only of".

The invention claimed is:

1. A lifting insert for embedment in a concrete element to facilitate lifting of the concrete element by a lifting link which co-operates with the lifting insert, said lifting link having a body with two exterior spaced apart cheeks defining a spacing therebetween and a latch which extends across a slot in said body, said insert comprising:

a head at one end for releasable engagement with said lifting link, another end for embedment within the concrete element, and an insert longitudinal axis extending between said ends, said head having two sides which extend in a direction of said longitudinal axis and a width therebetween, wherein the width of said head exceeds the spacing between said cheeks;

said head having a through hole shaped to receive said lifting link latch, and said head having a thickness and being dimensioned so that the head is receivable within said slot;

said head being of non-uniform thickness at least in a region between said through hole and said one end and also between said through hole and at least one of said sides, such that in at least said region of said head the thickness of the head beyond said cheeks is greater than the head thickness receivable by said slot, thereby forming at least one abutment surface of increased thickness against which one of said cheeks of said body directly bears during lifting.

2. The insert as claimed in claim 1 wherein the insert has a second moment of inertia in a plane normal to said insert longitudinal axis, and wherein the non-uniform thickness of said insert is shaped so that said second moment of inertia in said plane normal to said longitudinal axis of the insert, is increased.

3. The insert as claimed in claim 1 wherein the said head has a transverse cross-sectional shape comprising an L shape.

4. The insert as claimed in claim 1 and having a pair of abutment surfaces each located adjacent one side of said insert.

5. The insert as claimed in claim 1 and having two pairs of abutment surfaces, one pair of said abutment surfaces being located adjacent one side of said insert, and the other pair of said abutment surfaces being located adjacent the other side of said insert.

6. The insert as claimed in claim 1 and having a single abutment surface.

7. The insert as claimed in claim 1 and being elongate.

8. The insert as claimed in claim 1 and being truncated.

9. The insert as claimed in claim 1 wherein said head is formed with at least one longitudinal extending groove each defined by a pair of opposed abutment surfaces spaced apart by a distance corresponding to the spacing between said cheeks.

10. The insert as claimed in claim 9 wherein said groove (s) do not extend beyond said through hole.

11. The insert as claimed in claim 9 wherein said insert has two side faces and each said groove has a base which is substantially flush with a corresponding side face of said insert.

12. The insert as claimed in claim 11 wherein each said abutment surface is proud of the adjacent side face.

13. The insert as claimed in claim 9 having a pair of grooves positioned one on each opposite side of said head.

14. The insert as claimed in claim 13 wherein said head has a transverse cross-sectional shape selected from the class consisting of an I-beam, and a bowtie.

15. The insert as claimed in claim 9 having a single groove whereby said head has a transverse cross-section which is a substantially U-shaped channel.

16. The insert as claimed in claim 15 wherein said subsantially U-shaped channel is formed by a pair of tapering surfaces.

17. The insert as claimed in claim 15 wherein said substantially U-shaped channel is formed by a pair of longitudinally extending ridges.

18. The insert as claimed in claim 17 wherein said longitudinal extending ridges extend continuously from said one end to beyond said through hole.

19. The insert as claimed in claim 17 wherein said longitudinal extending ridges are intermittent.

20. A concrete element having an insert cast into the concrete element, said insert being as claimed in claim 1.

21. A method of raising a substantially planar concrete element having a substantially vertical side edge into which is cast the lifting insert of claim 1, said method comprising the steps of:

(a) engaging said head with the lifting link body having the slot dimensioned to receive said head, said slot being located between the cheeks;

(b) passing the latch of said body through said through hole; and (c) raising said body whilst engaging one of said cheeks with at least one region of said head which, in a direction parallel to said through hole axis, exceeds the distance between said cheeks, said region forming the abutment surface for said one cheek, which abutment surface extends longitudinally along said head.

* * * * *